United States Patent [19]

Bustin

[11] 4,158,955

[45] Jun. 26, 1979

[54] DEPRESSION FORMING TOOL

[76] Inventor: Leopold Bustin, Emmans Rd., Flanders, N.J. 07836

[21] Appl. No.: 874,894

[22] Filed: Feb. 3, 1978

[51] Int. Cl.[2] ..... B21J 9/18

[52] U.S. Cl. ..... 72/414; 72/454; 72/461; 72/475

[58] Field of Search ..... 72/414, 415, 454, 475, 72/379, 461, 36

[56] References Cited

U.S. PATENT DOCUMENTS

| | | | |
|---|---|---|---|
| 640,271 | 1/1900 | Cassidy | 72/454 |
| 1,695,476 | 12/1928 | Winkler | 72/414 |
| 2,285,099 | 6/1942 | Specht | 72/454 |
| 2,427,756 | 9/1947 | West | 72/379 |
| 2,903,929 | 9/1959 | McVey | 72/454 |
| 3,078,904 | 2/1963 | Bishop | 72/454 |

*Primary Examiner*—C. W. Lanham
*Assistant Examiner*—Gene P. Crosby
*Attorney, Agent, or Firm*—Carella, Bain, Gilfillan & Rhodes

[57] ABSTRACT

A tool for forming a depression in a strap of material which is disclosed to comprise a C-clamp base, a reaction cup on one arm of the C-clamp base and a bolt-like deforming member threadedly mounted through the other arm of the C-clamp base. A bearing is provided at the head of the bolt to facilitate deformation and locator means are provided on the base of the clamp to gauge the distance of the depression from the edge of the material in which the depression is to be formed.

3 Claims, 3 Drawing Figures

DEPRESSION FORMING TOOL

BACKGROUND OF THE INVENTION

This invention relates to tools. In particular this invention relates to portable tools which are capable of being taken to a site for use.

As is well known by those having skill in these arts it is often desirable to form depressions in sheets of metal or straps of metal to form, e.g., dimples and the like. Dimpling is ordinarily done in shops on permanently installed equipment which has the benefit of hydraulic motors and the like.

Situations arise, however, wherein it is desirable to be able to form depressions in sheets or straps of material without removing the material from its place of installation, e.g. a truck or the like to a shop to gain access to the permanently installed machine equipment. A typical example of such a situation is found with respect to the formation of depressions in straps for mounting a step on the tank of a truck such as is disclosed in my copending application Ser. No. 767,688 filed Feb. 11, 1977 for STEP MOUNTING STRUCTURE FOR A VEHICLE TANK, now U.S. Pat. No. 4,102,432.

In that application a step for mounting on tank structure of a vehicle which is supported by straps is disclosed to include bracing structure and bearing plates provided with dimples. The bearing plate dimples cooperate with dimples formed in the tank support straps to maintain the position of the step with respect to the tank rigidly and substantially incapable of relative motion therebetween.

It will be recognized by those skilled in these arts that it would be highly advantageous to provide a dimpling tool which would form dimples in the tank support straps without requiring removal of the entire strap to a shop for access to machinery.

This invention directs itself to the provision of such a tool.

SUMMARY OF THE INVENTION

It is an object of the present invention, therefore, to provide a hand tool which is capable of forming a depression in a sheet or strap of material such as metal.

It is a further object of the invention to provide a hand tool for forming a depression in a sheet or strap of material which requires no electrical, hydraulic or other external power means.

Yet another object of the present invention is to provide a hand tool for forming a depression in a strap or sheet of material which does not cause damage to the surface of the material being depressed during deformation.

A still further object of the present invention is to provide a tool for forming a depression in a strap or sheet of material which is simple in design, inexpensive to manufacture and straight forward in its use.

These objects and others not enumerated are achieved by the tool of the present invention one embodiment of which may include a C-structural member having a base element and first and second arms, a tapped bore formed through the first arm, a counterbore formed in the second arm in coaxial alignment with the tapped bore, the counter-bore defining a reaction surface for the material depression and pressure generating means mounted on the C-shaped structural member comprising a threaded bolt in threaded relationship with the tapped bore and a means for engaging the material being deformed to cause the depression.

BRIEF DESCRIPTION OF THE DRAWING

A more complete understanding of the present invention may be had from the following detailed description thereof particularly when read in the light of the accompanying drawings wherein.

DETAILED DESCRIPTION

Figure 1:
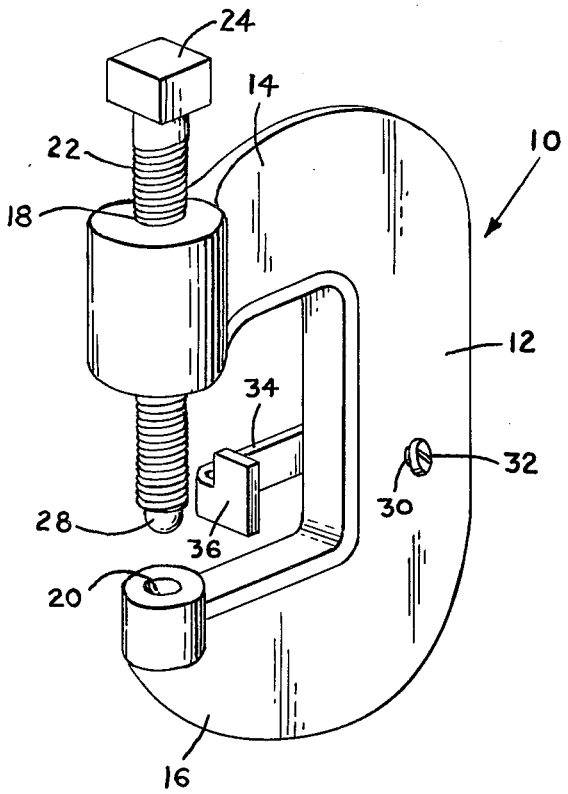
FIG. 1 is a perspective view of a tool structure in accordance with the invention.

As noted above this invention relates to a tool for forming a depression in a plate or strap of material such as metal. Referring therefore to the drawings, an apparatus structured in accordance with the invention is shown in FIG. 1 and designated generally by the reference numeral 10.

Apparatus 10 includes a generally C-shaped structural member having a base element 12 a first upper arm 14 and a second lower arm 16. First upper arm 14 is provided with an enlarged end through which is provided a tapped bore 18. Tapped bore 18 is in axial alignment with a counterbore 20 formed in second arm 16.

Figure 2:
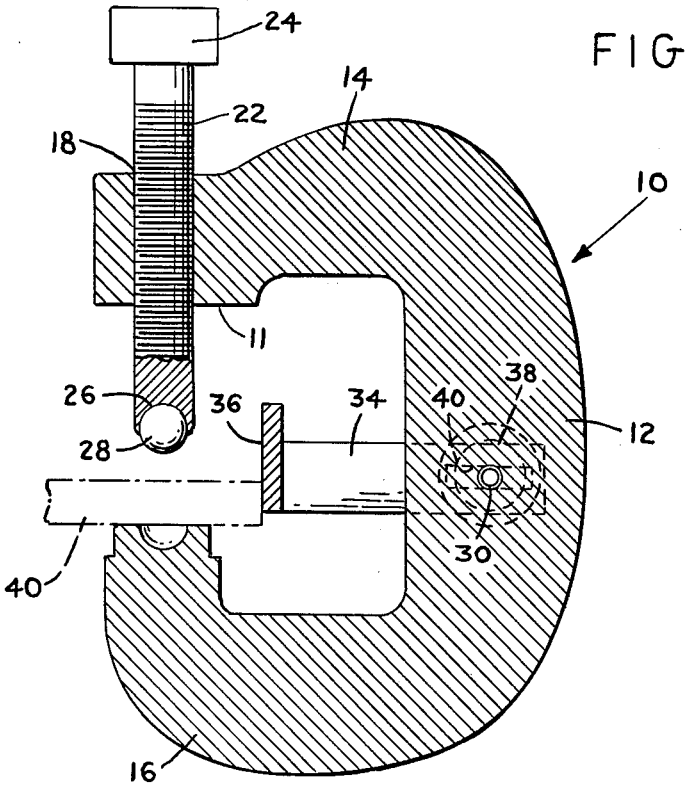
FIG. 2 is a cross-sectional elevational view of the apparatus of FIG. 1.
Figure 3:
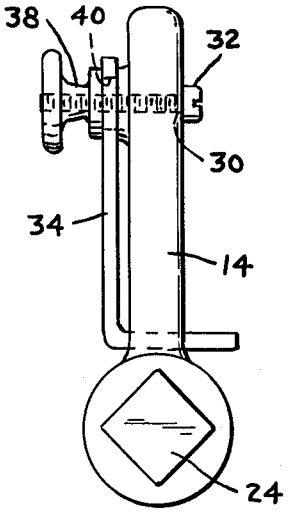
FIG. 3 is a plan view of the apparatus of FIG. 1.

Threadedly mounted within tapped bore 18 is a pressure generating means comprising a bolt element 22 having a head 24 formed thereon. Head 24 is disposed on the upper end of bolt element 22 as seen in FIGS. 1 and 2. Formed in the lower end of bolt element 22 is a cavity 26 for receiving therein a ball bearing 28. The end of bolt element 22 is swaged such as to hold bearing 28 in rotatable position within the end of the bolt. Thus, as is discussed below, bolt 22 can be rotated with bearing 28 in contact with the surface of a material and no rotational movement is imparted to the surface of the material.

Formed transversely through base element 12 of the structural member is a bore 30. Bore 30 is tapped and threadedly receives therein a machine screw 32 which is utilized to secure gage 34 in a desired position. More specifically, gage 34 includes a work engaging element 36 which extends transversely across the opening of C-element 11 and a connector lock 38 which extends along the side surface of base element 12. Connector lock 38 is provided with an elongated slot 40 through which machine screw 32 is passed.

Gage 34 is provided to limit the distance of insertion of a workpiece into the bight of C-shaped element 11. More specifically, an operator may predetermine the desired location of the centerline of a depression to be formed in a workpiece (40 in FIG. 2) from the edge of the workpiece. With this dimension, the operator may position the surface of work engaging element 36 at the predetermined dimension from the centerline of bolt element 22 and secure gage 34 in that position by tightening down on machine screw 32.

With the apparatus so set, a workpiece 40 may be positioned as shown in FIG. 2 and thereafter bolt 22 may be screwed downwardly until bearing 28 engages workpiece 40. Continued advance of bolt 22 will cause formation of the desired depression in workpiece 40, limited only by the depth of counterbore 20. As will be recognized by those skilled in these arts, bolt head 24 is provided to accommodate the reception thereover of a wrench. Thus deformation pressure may be generated against a workpiece by screwing the bolt element 22 toward workpiece 40 until bearing 28 engages the workpiece and thereafter further advancing bolt 22 by wrench until the desired degree of deformation is achieved.

It will be clear to those having ordinary skill in these arts that the apparatus of this invention is extremely simple in its design and operation. The C-shaped element may be a conventional C-clamp component, e.g. a cast steel element. The remaining components may be manufactured using any of the generally known manufacturing techniques. Further, the materials utilized may be selected from any of the many which are generally known in these arts.

Although the present invention has been disclosed in terms of a preferred embodiment, it will be recognized by those having skill in these arts that many modifications and variations may be made to the preferred embodiment without departing from the spirit and the scope thereof.

What is claimed is:

1. Apparatus for forming a depression in a strap of material comprising:

a C-shaped structural member, said C-shaped structural member having a base element, a first arm and a second arm;

a tapped bore formed through said first arm;

a counterbore formed in said second arm, said counterbore in coaxial alignment with said tapped bore in said first arm; and pressure generating means mounted on said C-shaped structural member, said pressure generating means including a head-end and a contact end, a threaded bolt in threaded relationship with said tapped bore in said first arm, said threaded bolt including means for engaging said strap to form said depression, and wherein said contact end includes a ball bearing rotatably received in said pressure generating means for engaging said strap.

2. Apparatus for forming a depression in a strap of material comprising:

a C-shaped structural member, said C-shaped structural member having a base element, a first arm and a second arm;

a tapped bore formed through said first arm;

a counterbore formed in said second arm, said counterbore in coaxial alignment with said tapped bore in said first arm;

pressure generating means mounted on said C-shaped structural member, said pressure generating means comprising a threaded bolt in threaded relationship with said tapped bore in said first arm, said threaded bolt including means for engaging said strap to form said depression; and means mounted on said base element for limiting the amount of insertion of a strap between said first arm and said second arm.

3. Apparatus according to claim 2 wherein said pressure generating means includes a head-end and a contact end, said head-end including a bolt head formed thereon.

* * * * *